US007222581B1

(12) United States Patent
Smith et al.

(10) Patent No.: US 7,222,581 B1
(45) Date of Patent: May 29, 2007

(54) TRANSITION DEVICE FOR COUPLED METAL FRAMES

(75) Inventors: Ernest Mayo Smith, Sanford, FL (US); David Gregory Chapman, Chuluota, FL (US)

(73) Assignee: Water Bonnet Manufacturing, Inc., Casselberry, FL (US)

( * ) Notice: Subject to any disclaimer, the term of this patent is extended or adjusted under 35 U.S.C. 154(b) by 0 days.

(21) Appl. No.: 11/560,068

(22) Filed: Nov. 15, 2006

Related U.S. Application Data

(60) Provisional application No. 60/737,717, filed on Nov. 17, 2005.

(51) Int. Cl.
*B63B 17/02* (2006.01)

(52) U.S. Cl. ..... 114/361; 296/96.21

(58) Field of Classification Search ..... 114/361; 296/87, 88, 92, 96, 96.21, 96.12, 96.13
See application file for complete search history.

(56) References Cited

U.S. PATENT DOCUMENTS 1,338,487 A * 4/1920 Chamberlin ..... 296/92
1,788,436 A * 1/1931 Lunt ..... 114/361
3,654,648 A * 4/1972 Wilhoit ..... 114/361
3,829,153 A * 8/1974 Fussell et al. ..... 296/90
4,151,620 A * 5/1979 Heuzonter ..... 114/361
5,784,982 A * 7/1998 Erskine ..... 114/361

* cited by examiner

*Primary Examiner*—Ed Swinehart

(74) *Attorney, Agent, or Firm*—James H. Beusse; Beusse Wolter Sanks Mora & Maire, P.A.

(57) ABSTRACT

A transition device for providing a smooth corner of a pair of angular oriented interconnected windshields on a boat, the boat having a forward facing or front windshield and a side facing windshield, both the windshields being mounted in a formed aluminum molding. The transition device comprises a first element attached to the molding of the forward facing windshield at an upper end of the joint and terminating at the joint in a ball and a second element attached to the molding of the side facing windshield at the upper end of the joint and terminating in a socket. The ball and the socket are shaped and sized to fit together to form a smooth transition at the upper end of the joint so that the corner joint appears to have a ball and socket joint.

3 Claims, 6 Drawing Sheets

28D 28F
28B
28E
28

28D 28B
28C
28A
28

30C

30B 30C
30B 30F
30E 30B
30A
30C
30

30
29

30
28

TRANSITION DEVICE FOR COUPLED METAL FRAMES

This application claims the benefit of U.S. provisional application No. 60/737,717, filed Nov. 17, 2005.

BACKGROUND OF THE INVENTION

The present invention relates to interconnected metal frames for sheet structures and, more particularly, to an apparatus for providing an adjustable and smooth transition between corner joints of abutting metal frames.

Sheet or plate assemblies, such as windscreens, e.g., windshields, have a sheet member that is generally supported in some form of frame structure. The sheet member may be a glass or plastic. For example, windscreens used for boats generally have a tempered glass sheet that is supported within an aluminum frame. The frame is made up of metal, typically aluminum, channels that have various different cross sectional configurations but at least have a lengthwise extending slot into which the glass sheet fits. Some form of seating material is placed in the slot to support the glass sheet in the slot and out of contact with the metal frame.

The present invention has particular utility in the assembly of metal framed windshields on boats but can be used in any application in which metal frames are brought together at different angular orientations. In an application as applied to a boat, it is common to have a windshield extending transversely across a bow of a boat with such front windshield encased in a metal frame. There are also provided side windshields extending at an angle from the front windshield to support the small side windows that prevent spray from entering the boat from the sides. The front windshield frame may be formed in four sections comprising a top section, a bottom section and a pair of opposite side sections. The bottom section of frame is particularly configured to allow attachment to a bow of the boat for supporting the windshield in an upright position. The top section extends along a top edge of the windshield while the side sections extend vertically between the bottom section and the top section of the frame. The side windshields may be structured differently, such as in a triangular configuration so that only three frame sections are used, i.e., a front section that mates with the side section of the front windshield and a top and bottom section that extend from the front section and outline the other two edges of the triangular side windshield.

Typically, a variable angle joint is created between the front windshield and the side windshield using a pair of mating channels formed in respective ones of the side frame section on the front windshield and the front frame section on the side windshield. One of these two mating frame sections may be formed with a longitudinal slot with an arcuate cross section and the other may be formed with an arcuately shaped longitudinal flange that fits into and mates with the slot in the one of the frame sections. The arcuate cross section of the slot and flange of the two mating frame sections allows some degree of angular adjustment between a plane of the front windshield and a plane of the side windshield. What this particular joint does not address is a transition between the upper frame sections of the front and side windows and the ends of the two mating side sections where all four sections meet to form a corner. Quite often, this joint leaves an edge that can snag clothing or perhaps injure someone bumping into the edge. Further, because boats tend to be individually assembled, it is not unusual for the angle at which the trim pieces from the front windshield and a side windshield interest to be different from one boat to another. As a result, each boat may have individual trimming or shaping that needs to be done in order to create the joint between the front windshield frame and a side windshield frame.

SUMMARY OF THE INVENTION

In an exemplary embodiment, the present invention is described in association with a water vehicle, such as a boat, having a forward facing or front windshield and a side facing windshield, both the windshields being mounted in a formed aluminum molding, the improvement comprising a transition device for providing a smooth transition between the windshield at an angular joint between the windshields, the transition device comprising a first element attached to the molding of the forward facing windshield at an upper end of the joint and terminating at the joint in a ball, a second element attached to the molding of the side facing windshield at the upper end of the joint and terminating in a socket, the ball and the socket being shaped and sized to fit together to form a smooth transition at the upper end of the joint. In the illustrative form, the transition device may be characterized as a ball and socket joint.

In a preferred form, the first and second elements extend over and cover all terminating edges of the moldings at the joint so as to minimize any exposed edges of the moldings that could snag a persons clothing or skin. Each of the elements may be formed with tangs extending into the respective moldings to which they are attached. The elements may be held to the moldings by screws extending through at least a portion of each molding and engaging the tangs.

BRIEF DESCRIPTION OF THE DRAWINGS

For a better understanding of the invention, reference may be had to the following detailed description taken in conjunction with the accompanying drawing in which.

DETAILED DESCRIPTION OF THE INVENTION

Figure 1:
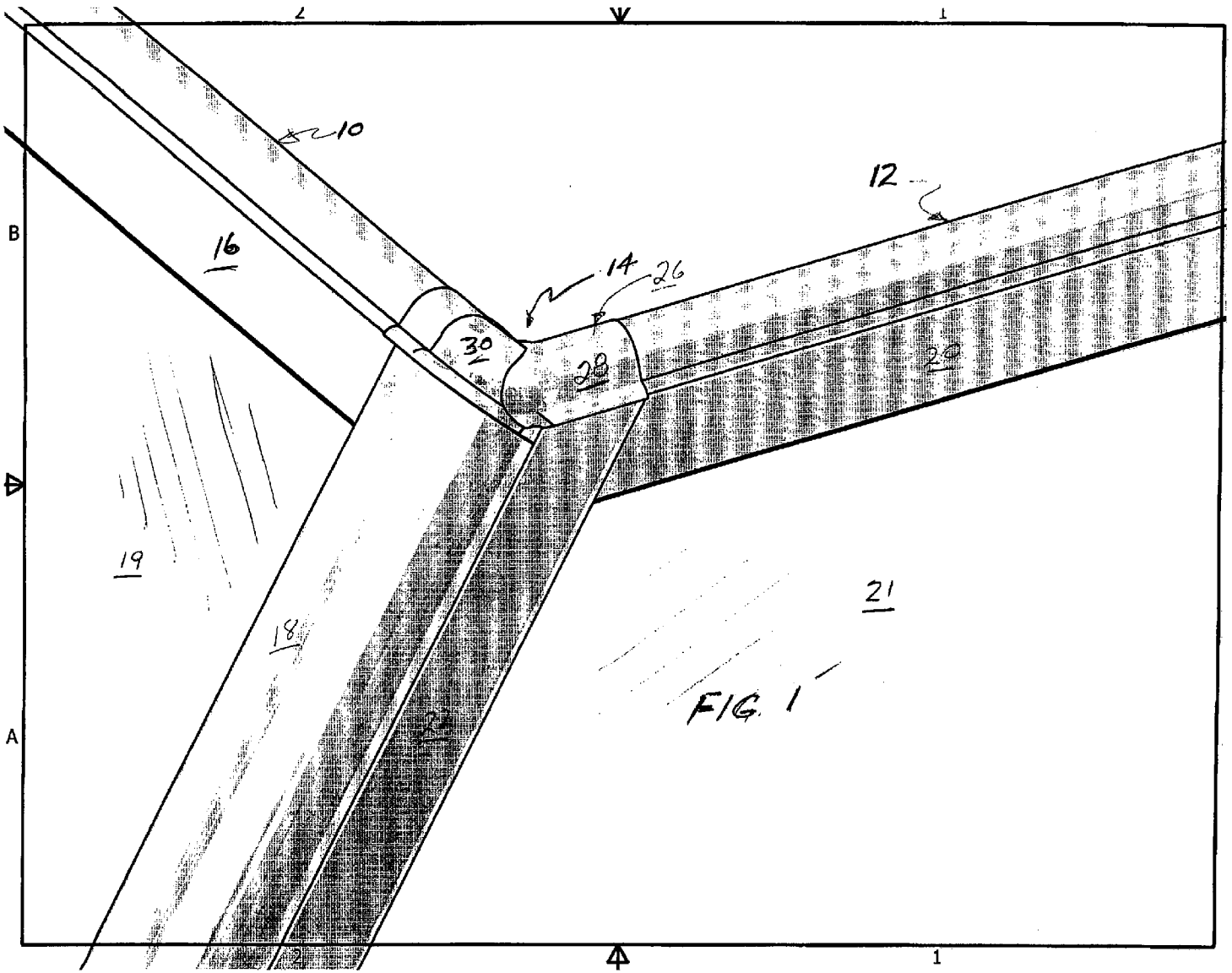
FIG. 1 is a perspective view of a corner joint formed by the intersection of four windshield moldings using the transition devices of the present invention.
Figure 2:
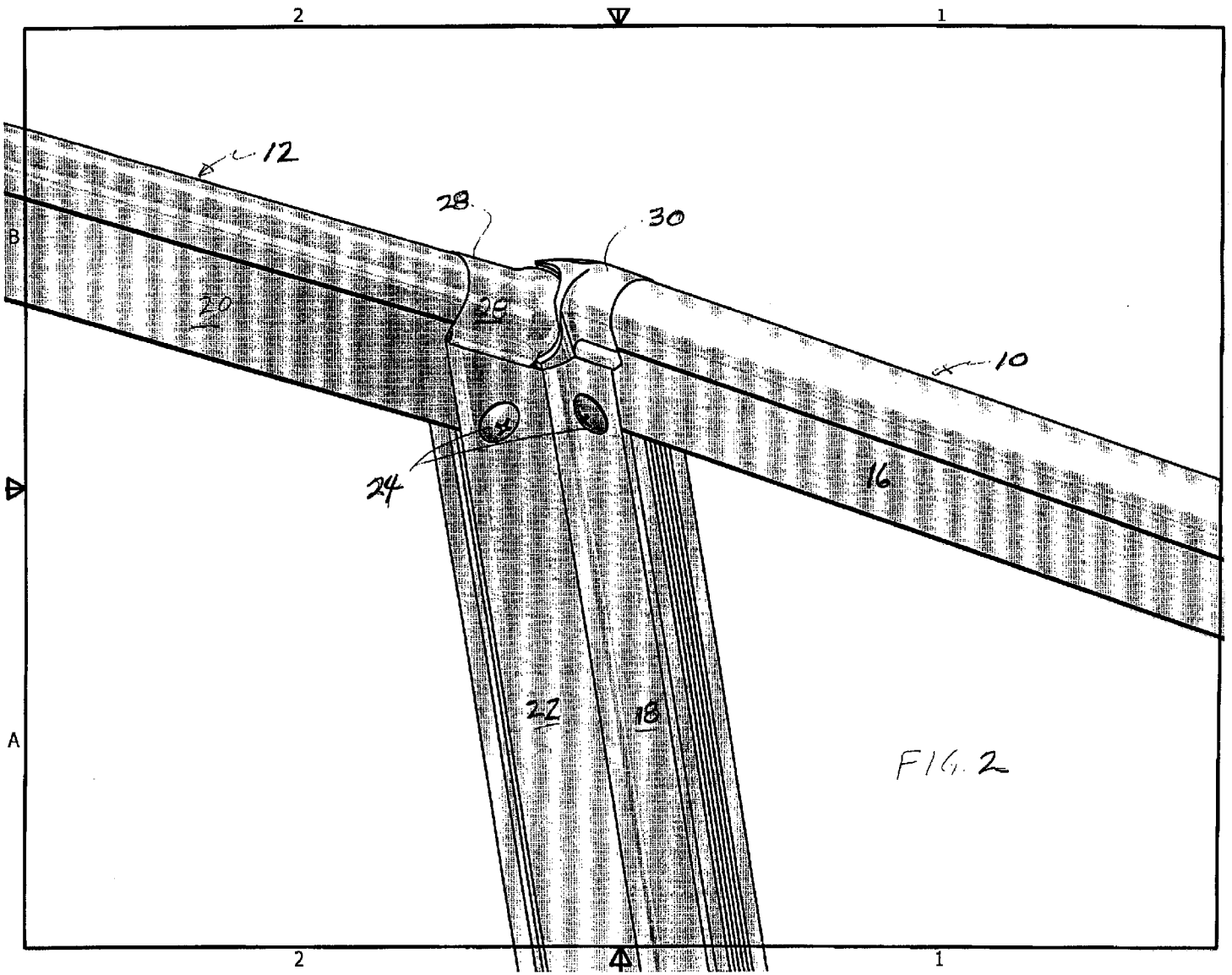
FIG. 2 is a reverse side view of the corner joint of FIG. 1.

The present invention comprises a transition device that is universally adapted to provide a transition between metal frames that will accommodate a wide range of angular orientations between the connected frames. Referring now to FIGS. 1 and 2, there is shown one example of a pair of metal frames 10 and 12 joined at the intersection or corner joint 14. The metal frame 10 comprises a top piece 16 and a vertical piece 18, each of which are joined together to form a frame surrounding a glass or plastic panel 19. The metal frame 12 comprises the top member 20 and a vertical member 22 that are also joined together to form a frame for a side glass or plastic panel 21. In FIG. 1, the frame 10 and panel 19 defines the forward windshield while frame 12 and panel 21 defines a side windshield or spray screen. The windshields are assemblies of transparent panels and supporting frames. FIG. 2 is a view of the joint 14 of FIG. 1 from a reverse position looking outward into the joint. Typically, the vertically extending members 18 and 22 are formed with an interlocking edge providing a relatively smooth transition along the edge from the side window to the front windshield. The interlocking edge may be the above described arcuate channel and mating arcuate shaped flange of a type well known in the boating industry. The vertically extending members 18 and 22 then attach to the upper frames 16 and 20 by means of screw connections indicated at 24. Because the corner intersection at 14 requires joining four different metal pieces, the joints tend to be somewhat rough creating edges that can snag or injure a person.

The present invention provides a means for transitioning at the joint 14 between the upper aluminum members 16 and 20, while at the same time providing a transition from each of the vertically extending members 18 and 22. As shown in FIG. 1, a transition member 26 is shown in one form as comprising a pair of mating elements 28 and 30. The element 28 is fastened to the upper frame member 20 while the element 30 is fastened to the upper frame member 16. The top surfaces of each of the element 28 and 30 are shaped to conform to the configuration of the top surface of each of the elements 16 and 20. At the intersection of the elements 28 and 30, the element 30 is provided with a ball socket while the element 28 terminates in a ball that sits within the ball socket of element 30. A reverse view of this ball and socket pair is shown in FIG. 2. The ball and socket allow the angle between the elements 16 and 20 to be adjusted without affecting the transition between the element 28 and the element 30.

Figures 3A, 3B, 3C, 3D, 3E, 3F, 3G:
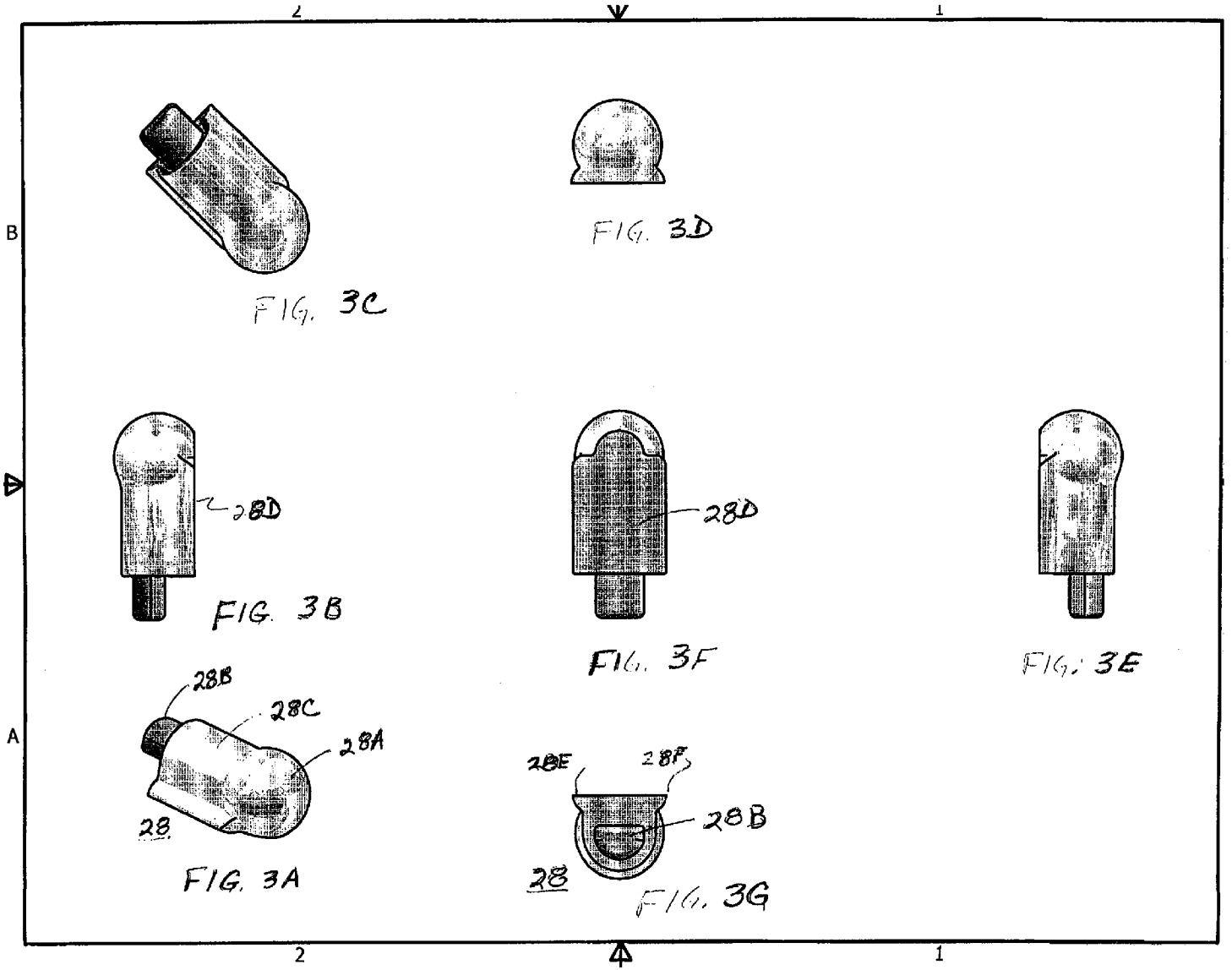
FIGS. 3A–3G are illustrations of one element of the transition devices taken from different viewer perspectives.

Referring to the drawings FIGS. 3A–3G, there are shown different views of the element 28 which terminates in the ball portion of the ball and socket connection. Turning first to the perspective view in FIG. 3A, it can be seen that the element 28 has a ball 28A at one end and a tang 28B at an opposite end. The portion in between the tang 28B and the ball 28A, identified as 28C, is generally shaped along its top surface to conform to the shape of the metal frame on which the ball is installed. As can be seen in the side view in FIG. 3B, the bottom surface 28D, also shown in FIG. 3F, is generally flat but may have different shapes depending upon the particular piece of metal frame on which the element 28 is to be installed. FIG. 3C is a top view of the element 28, FIG. 3D is a front view of the element 28 showing the ball 28A while FIG. 3G is an end view of element 28 showing the configuration of the tang 28B. FIG. 3E is merely a reverse view of FIG. 3B illustrating the symmetrical configuration in this embodiment. It should be noted in FIGS. 3A and 3G that the portion of the element 28 that abuts the moldings 22 is tapered outward to provide a slight overhanging edge at 28E and 28F that will cover the upper edges of the molding 22. Also, it is preferable to have the size of the element slightly larger in cross section than the end of the upper molding 20 so that the metal edge of the molding is covered at the joint 14.

Figures 4A, 4B, 4C, 4D, 4E, 4F, 4G, 4H, 4I:
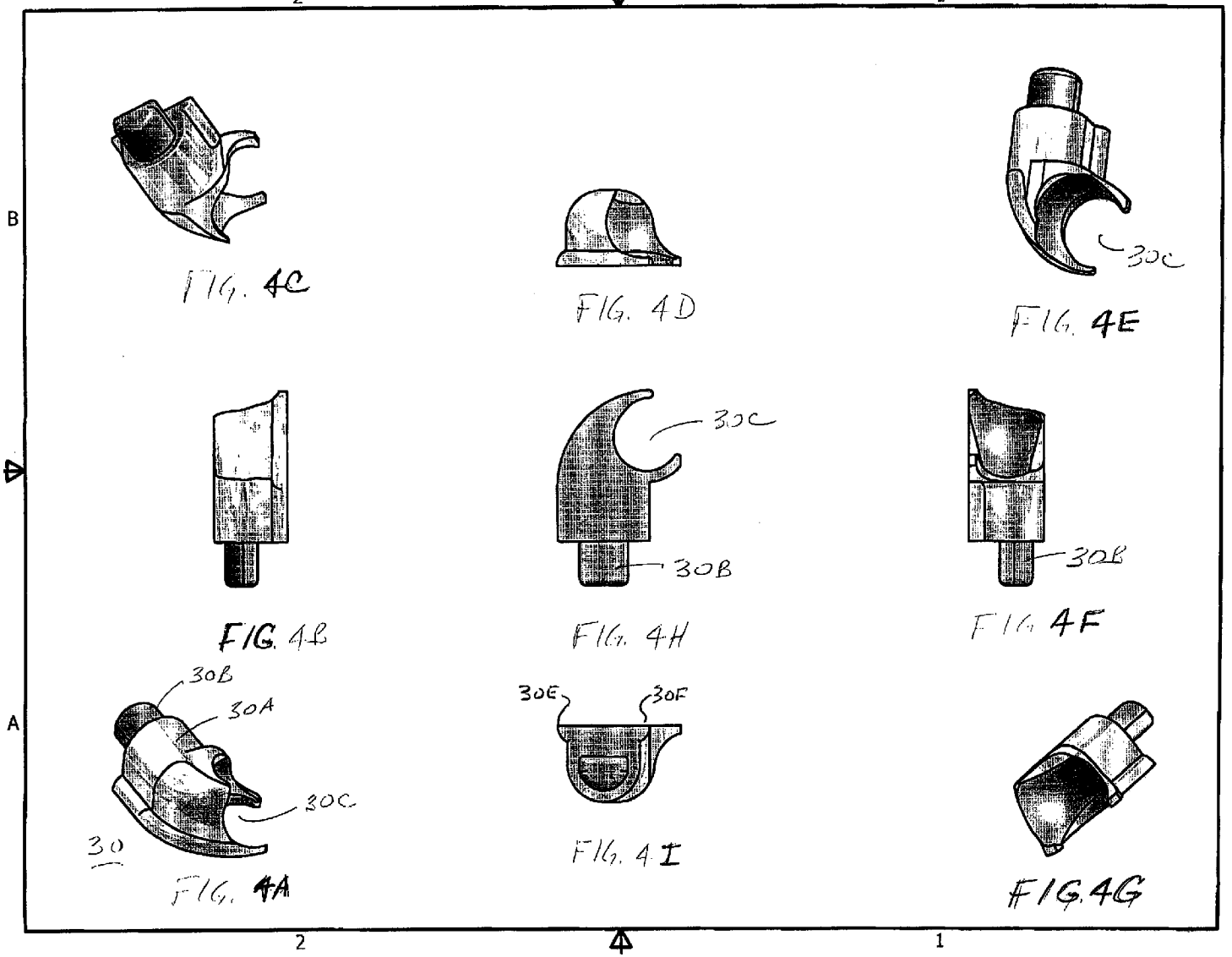
FIGS. 4A–4I are illustrations of the other of the transition devices taken from different viewer perspectives.

Referring now to FIG. 4 comprising FIGS. 4A–4I, there is shown different views of the element 30. FIG. 4A is a generally perspective view showing the top shape of the device at 30A with a tang 30B extending from the back of the device. The socket for receiving the ball 28A is indicated at 30C. As with the element 28, the element 30 has a top shape at 30A that is configured to mate with the top surface of the frame 16 but preferrably have a slight overlap to assure coverage of the metal edge of the molding 16. The general shape of the ball socket 30C can be seen in FIGS. 4E and 4H. The extent of the tang 30B extending from the rear of the element 30 is best seen in FIGS. 4F and 4H. FIG. 4B is a reverse side view of the element shown in FIG. 4F. Note that element 30 has a base 30D substantially identical to that of element 28 with outward directed flanges 30 E and 30F that overlap the top edges of the side molding 18

Figures 5A, 5B, 5C, 5D, 5E, 5F, 5G, 5H, 5I:
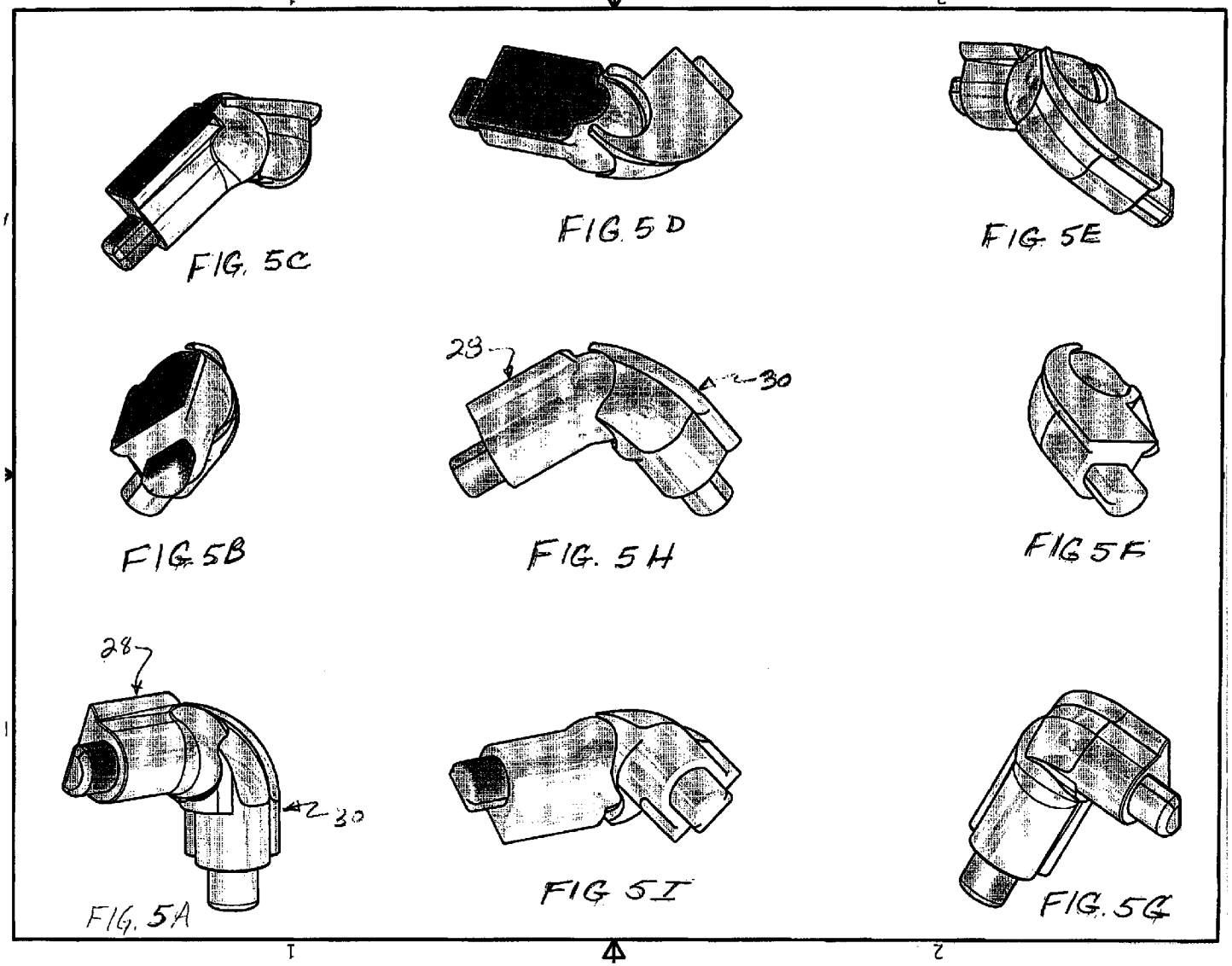
FIGS. 5A–5I are illustrations taken from different perspectives of the devices of FIGS. 3A–4I in their assembled configuration.

Turning now to FIG. 5, comprising the FIGS. 5A–5I, there are shown various views of the elements 28 and 30 in their mating position. The views in FIG. 5 illustrate how the ball 28A fits into the socket 30C to form a smooth transition between the elements 28 and 30. As can be seen in the views of FIG. 5, the ball and socket joint formed by elements 28 and 30 have a relatively wide range of motion that will allow for variation in the angle between the four moldings 16, 18, 20 and 22 at their juncture.

Figure 6:
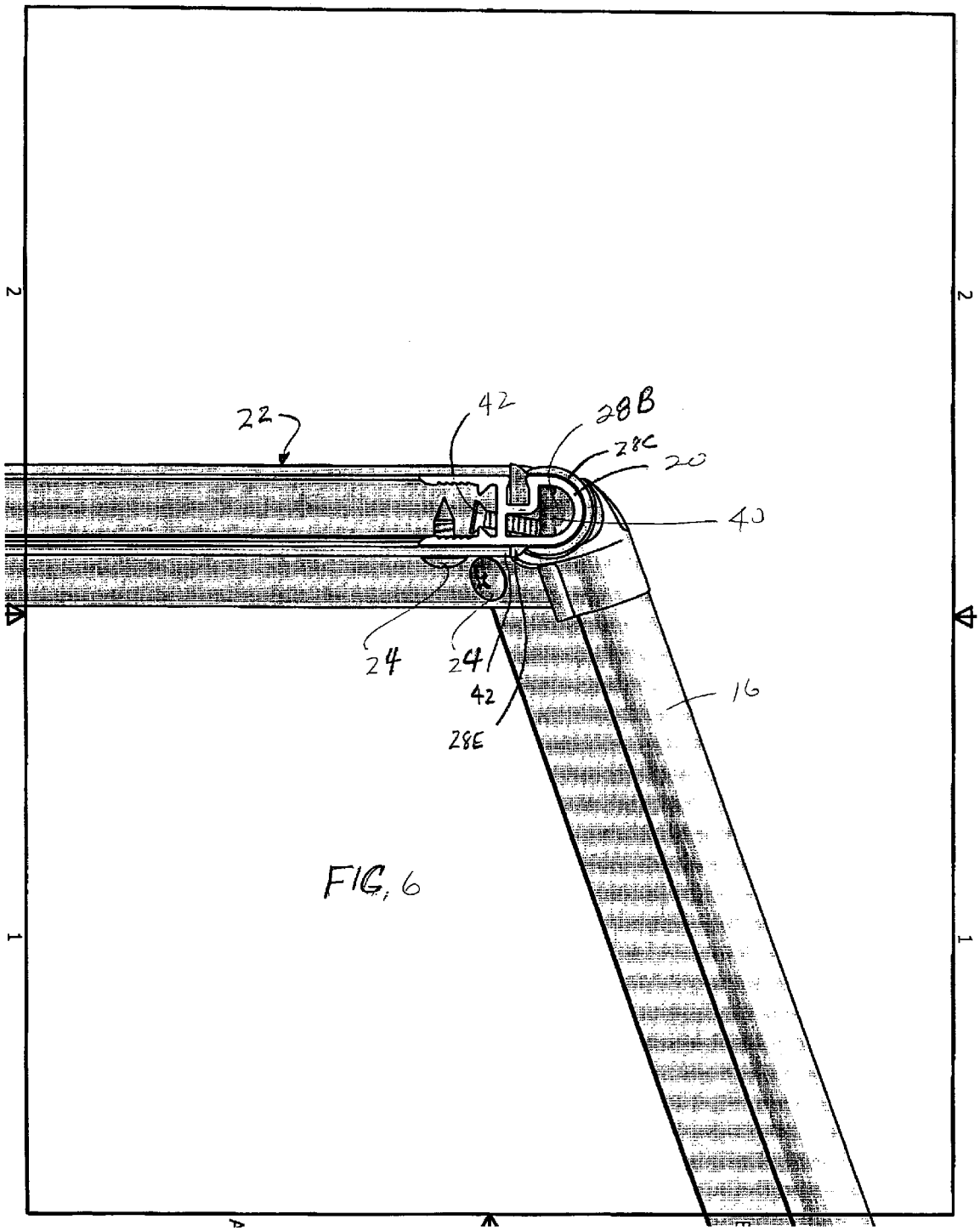
FIG. 6 is a partial cutaway view of the corner joint of FIG. 1 illustrating how the devices seat on the moldings.

Turning now to FIG. 6, there is shown a partial cross-sectional view through the frame member 20 illustrating how the elements 28, 30 fit into the moldings, in this instance, the element 28. As can be seen, the frame molding 20 in cross-section has a lengthwise extending channel 40 in which the tang 28B is seated. A screw 42 threaded into the bottom of the frame engages the tang 28B to prevent the element 28 from sliding out of its position or association with the frame member molding 20. The frame member molding 20 is also attached to the vertical member 22 by means of the screws 24. While this arrangement is a preferred embodiment for the particular type of molding 20 that is being used in this application, it will be apparent that other types of attachments of the elements 28 or 30 could be utilized with different molding shapes. It can also be seen that the flange 28E just slightly overhangs an edge of the molding at 42 and that the diameter of the element at body portion 28C is slightly larger than the molding 20.

While the invention has been described in what is presently considered to be a preferred embodiment, various modifications will become apparent to those skilled in the art. In particular, the invention may be modified or adapted to be used with other shapes of moldings and the configuration of the ball and socket joint may be changed without departing from the spirit and scope of the invention. It is intended therefore that the invention be interpreted within the full spirit and scope of the appended claims and not limited to the specific disclosed embodiment.

What is claimed is:

1. In a water vehicle having a forward facing windshield panel and a side facing windshield panel, both the windshields panels being mounted in a formed aluminum molding, the improvement comprising a transition device for providing a smooth transition between the windshield panels at a joint between the panels, the transition device comprising a first element attached to the molding of the forward facing windshield panel at an upper end of the joint and terminating at the joint in a ball, a second element attached to the molding of the side facing windshield panel at the upper end of the joint and terminating in a socket, the ball and the socket being shaped and sized to fit together to form a smooth transition at the upper end of the joint.

2. The improvement of claim 1 wherein the first and second elements extend over and cover all terminating edges of the molding at the joint.

3. The improvement of claim 2 wherein the first and second elements each include tangs extending into the respective moldings to which they are attached.

* * * * *